US008701602B2

(12) United States Patent
Brückner et al.

(10) Patent No.: US 8,701,602 B2
(45) Date of Patent: Apr. 22, 2014

(54) WASTE HEAT STEAM GENERATOR

(75) Inventors: Jan Brückner, Uttenreuth (DE); Joachim Franke, Nürnberg (DE); Holger Schmidt, Erlangen (DE); Frank Thomas, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 506 days.

(21) Appl. No.: 13/062,727

(22) PCT Filed: Sep. 7, 2009

(86) PCT No.: PCT/EP2009/061521

§ 371 (c)(1),
(2), (4) Date: Mar. 8, 2011

(87) PCT Pub. No.: WO2010/029033

PCT Pub. Date: Mar. 18, 2010

(65) Prior Publication Data

US 2011/0162594 A1 Jul. 7, 2011

(30) Foreign Application Priority Data

Sep. 9, 2008 (EP) ..... 08015864

(51) Int. Cl.
*F22B 1/18* (2006.01)

(52) U.S. Cl.
USPC ..... 122/488; 122/7 R

(58) Field of Classification Search
USPC ..... 122/7 R, 34, 488, 489
See application file for complete search history.

(56) References Cited

U.S. PATENT DOCUMENTS

| | | | | |
|---|---|---|---|---|
| 7,628,124 | B2 * | 12/2009 | Bruckner et al. | 122/470 |
| 2012/0180739 | A1 * | 7/2012 | Rop et al. | 122/7 R |

FOREIGN PATENT DOCUMENTS

| | | | |
|---|---|---|---|
| DE | 197 17 158 | A1 | 11/1998 |
| EP | 1 701 090 | A1 | 9/2006 |
| EP | 1 701 091 | A1 | 9/2006 |
| EP | 1 710 498 | A1 | 10/2006 |

* cited by examiner

*Primary Examiner* — Gregory A Wilson

(57) ABSTRACT

A waste heat steam generator including evaporator tubes is provided. The evaporator tubes are connected in parallel on the flow medium side, a plurality of overheating tubes are mounted downstream of the evaporator tubes using a water separation system. The water separation system includes water separation elements, each water separation element being respectively mounted downstream of the plurality of evaporator tubes and/or upstream of a plurality of overheating tubes. Each water separating element includes an inlet pipe which is respectively connected upstream to the evaporator tubes, the inlet pipe extending into a water evacuation pipe when seen in the longitudinal direction. A plurality of outflow pipes branch off in the transitional area, the pipes being connected to an inlet collector of the overheating tubes which are respectively connected downstream. A distribution element is arranged on the steam side between the respective water separating element and the inlet collector.

8 Claims, 5 Drawing Sheets

WASTE HEAT STEAM GENERATOR

CROSS REFERENCE TO RELATED APPLICATIONS

This application is the US National Stage of International Application No. PCT/EP2009/061521, filed Sep. 7, 2009 and claims the benefit thereof. The International Application claims the benefits of European Patent Office application No. 08015864.5 EP filed Sep. 9, 2008. All of the applications are incorporated by reference herein in their entirety.

FIELD OF INVENTION

The invention relates to a waste heat steam generator having a plurality of evaporator tubes which are connected in parallel on the flow medium side, downstream of which is mounted a plurality of superheating tubes, with the water separation system comprising a number of water separation elements, downstream of each of which is connected a number of evaporator tubes and/or upstream of which is connected a number of superheater tubes, with each of the water separation elements comprising an inflow tube section connected to a respective upstream evaporator tubes which, when seen in its longitudinal direction, extends into a water evacuation pipe section, with a number of outflow tube sections branching off in the transitional area which are connected to an inlet collector of the downstream superheater tubes in each case.

BACKGROUND OF INVENTION

A waste heat steam generator is a heat exchanger which recovers heat from a stream of hot gas. Waste heat steam generators are typically used in combined-cycle gas and steam turbine power stations, in which the hot waste gases are conveyed to one or more gas turbines in a waste heat steam generator. The steam generated therein is subsequently used to drive a steam turbine. This combination produces electrical energy considerably more efficiently than gas or steam turbines alone.

Waste heat steam generators are able to be categorized on the basis of a plurality of criteria: Based on the direction of flow of the stream of gas, waste heat steam generators can for example be classified into vertical and horizontal designs. Furthermore steam generators exist with a plurality of pressure stages with different thermal states of the respective water-steam mixture contained therein.

Steam generators can generally be designed as natural circulation, forced circulation or continuous-flow steam generators. In a continuous-flow steam generator the heating of the evaporator tubes leads to a complete evaporation of the flow medium in the evaporator tubes in one pass. The flow medium—usually water—is fed after its evaporation to superheater tubes connected downstream from the evaporator tubes and superheated there. The position of the evaporation end point, i.e. the point of the transition from a flow with residual moisture to pure steam flow is variable and dependent on mode of operation in such cases. During full-load operation of such a continuous-flow steam generator the evaporation end point typically lies in an end area of the evaporator tubes, so that the superheating of the evaporated flow medium is already beginning in the evaporator tubes.

A continuous-flow steam generator, unlike a natural-flow or forced-flow steam generator, is not subject to any pressure restriction, so that it can be designed for fresh-steam pressures far above the critical pressure of water ($p_{krit}$≈221 bar)— in which water and steam cannot occur simultaneously at any temperature and thus no phase separation is possible either.

In order to guarantee secure cooling of the evaporator tubes, such a continuous-flow steam generator is usually operated in low-load mode or on start-up with a minimum flow of flow medium in the evaporator tubes. The minimum flow of flow medium provided for operation is thus not completely evaporated on starting up or in low-load mode in the evaporator tubes, so that with this type of operating mode, elements of unevaporated flow medium, i.e. a water-steam mixture, are still present at the end of the evaporator tubes.

Since the superheater tubes downstream from the evaporator tubes of the continuous-flow steam generator are usually not designed for a comparatively large throughflow of unevaporated flow medium, continuous-flow steam generators are usually designed such that, even on starting up and in low-load mode, a disproportionate entry of water into the superheater tubes is safely avoided. To this end the evaporator tubes are usually connected to their downstream superheater tubes via a water separation system. The water separator brings about a separation of the water-steam mixture escaping during start-up or in low-load mode from the evaporator tubes into water and steam. The steam is fed to the superheater tubes downstream of the water separation system whereas the separated water is typically fed back into the evaporator tubes via a circulation pump or can be drained away via an expansion unit.

The water separation system in this case can comprise a plurality of water separation elements which are integrated directly into the tubes. In such cases each of the parallel-connected evaporator tubes can especially be assigned a water separation element. The water separation elements can further be embodied as so-called T-piece water separation elements. Each T-piece water separation element in these cases comprises an inlet tube section connected to the upstream evaporator tube which, when seen in its longitudinal direction, extends into a water evacuation tube section, with an outflow tube section connected to the downstream superheater tube branching off in the transitional area.

This construction means that the T-piece water separation element is designed for inertial separation of the water-steam mixture flowing from the upstream evaporator tube into the inflow tube section. As a result of its comparatively high inertia, the proportion of water of the flow medium flowing into the inflow tube section at the transitional point namely preferably flows onwards in an axial extension of the inflow tube section and thus reaches the water evacuation tube section and from there usually flows on into a connected collection container. The steam component of the water-steam mixture flowing into the inflow tube section on the other hand, as a result of its comparatively small inertia, can better follow a forced redirection and thus flows via the water evacuation pipe to the downstream superheater tube section. A waste heat steam generator of this construction designed for continuous-flow mode is known for example from EP 1 701 090.

In a continuous-flow steam generator with a water separation system designed in this way, the local integration of the water separation into the individual tubes of the tube system of the continuous-flow steam generator means that the water can be separated without prior collection of the flow medium flowing out of the evaporator tubes. This means that a direct forwarding of the flow medium into an inlet collector of the downstream superheater tubes is also possible.

As a result of the construction the transfer of flow medium to the superheated tubes is additionally not just restricted to steam, instead a water-steam mixture can now also be passed on to the superheater tubes in that the water separation elements are oversupplied. This means that the evaporation end point can be relocated into the superheater tubes if required. This allows an especially high operational flexibility to be achieved, even on start-up or in low-load mode of the continuous-flow steam generator. In particular the fresh steam temperature can be regulated within comparatively wide limits by influencing the feed water quantity.

However account needs to be taken in such systems of the fact that, because the water separation function is already integrated into the individual tubes in the area of the separation system, a comparatively large number of individual tube sections or elements are required.

SUMMARY OF INVENTION

The underlying object of the invention is thus to specify a waste heat steam generator of the type described above which, while retaining an especially high operational flexibility, brings with it a comparatively low construction and repair outlay.

This object is inventively achieved by a distributor element being arranged on the steam side between the respective water separation element and the inlet collector of the subsequent heating surface.

In this case the invention is based on the idea that, with local water separation, which occurs in the design described above in each of the evaporator tubes connected in parallel, a comparatively large number of T-piece water separation elements can lead to construction problems when used in large systems. The space problems which can be involved in accommodating this type of large number of water separation elements mean that such a design, as a result of the high constructional outlay associated therewith, can also involve significant extra costs and restrictions on the geometrical parameters of the waste heat steam generator.

A reduction in the construction cost of the waste heat steam generator could be achieved by a simpler design of the water separation system. For this purpose the number of water separation elements used can be reduced. However, in order to obtain the benefits of local water separation, such as the option of through-feed with a water-steam mixture, the basic design in the form of T-piece water separation elements should be retained. The combination of the two aforementioned concepts can be achieved by collecting the flow media of a plurality of respective evaporator tubes in one water separation element in each case.

A reduced number of T-piece water separation elements means that a direct steam-side forwarding to the inlet collector of the downstream superheater tubes can however lead to inhomogeneities in the distribution to the different superheater tubes. Thus, in order to achieve an even distribution to the downstream superheater tubes after the exit of the steam or the water-steam mixture from the T-piece water separation element, a distribution element is arranged on the steam side between the respective water separation element and the inlet collector.

Advantageously the geometrical parameters of a number of outlet tubes are selected such that a homogeneous flow distribution to the inlet collector of the respective downstream superheater tubes is guaranteed. This already achieves a homogeneous entry into the inlet collector which correspondingly continues in the downstream superheater tubes. The outlet tubes can in such cases typically have the same diameter and be routed evenly-spaced in parallel to each other into the inlet collector.

In an advantageous embodiment the distributor element is designed as a star distributor, i.e. it comprises a baffle plate, an input tube arranged at right angles to the baffle plate and a number of output tubes arranged in a star shape around the baffle plate. The inflowing water strikes the baffle plate and is distributed in a symmetrical fashion at right angles to the inflow direction and conveyed into the output tubes. In such cases in an especially advantageous embodiment the baffle plate is circular and the output tubes are arranged concentrically to the center of the baffle plate equally spaced from the respective adjacent output tubes. In this way an especially homogeneous distribution to the different output tubes is guaranteed.

In such cases there is advantageously provision for between five and 20 output tubes per distribution element. With a smaller number an adequate homogenization of the entry of steam or water-steam mixture into the inlet collector could no longer be achieved while a greater number can be problematic in the geometrical embodiment of the distributor element, especially when the latter is designed as a star distributor.

In a version of the water separation system as a T-piece separator there is the option of oversupply, i.e. forwarding of water-steam mixture into the superheater tubes. Any irregular flows which might occur in the evaporation process thus continue into the T-piece water separation elements and the downstream superheater tubes.

Such turbulent flows can especially occur in the form of so-called slugs which are caused by the different flow speeds of evaporated and non-evaporated flow medium in the tubes. A wave-like movement arises, which instigates a pulsing mass flow which can lead to mechanical and thermal stresses on the water separation elements and also on the downstream superheater tubes. To avoid this, measures should be taken to counter the further propagation of the turbulences from the evaporator tubes into the T-piece water separation elements and the downstream superheater tubes. In such cases this should be done before the entry of the water-steam mixture into the T-piece water separation elements. To this end, in an advantageous embodiment, a flow turbulence damper is provided in the inflow tube sections of a number of water separation elements in each case.

One of the reasons why the turbulences arise in the tube system is that two different phases of the flow medium are flowing in parallel to one another through the tube system. Eddies occur at the boundary surfaces of the two phases if the flow speeds differ greatly, which lead to a rapid local displacement of the boundary surface between the two phases in the form of a wave-type movement.

With especially strong turbulent flow these waves can be so great that they close off the entire tube cross-section and so-called slugs arise, i.e. areas with undamped flow medium and large mass alternating with areas primarily filled by steam, with a significantly smaller mass. These slugs generate a pulse-type mechanical stress on the entire tube system. In order to explicitly destroy these slugs and re-establish an even flow, in an advantageous embodiment the flow turbulence dampers each contain a number of bulkheads which each close off a part of the tube cross-section. These slugs break against the bulkheads, a part of the water is held back and is distributed to the area mainly dominated by steam which follows the slug. A smoothing of the waves is thus undertaken and a pulsation-free operation is established by smoothing the wave movements.

In order to arrange the components necessary for breaking these slugs to function correctly in the tubes upstream from the water separation elements, the direction of vibration in the wave movements entering the flow turbulence dampers should be known and predictable. In particular possible swirling movements of the inflowing water-steam mixture should be suppressed, since these can prevent the operation of the flow turbulence dampers. To this end the flow turbulence dampers advantageously contain a number of guide profiles aligned in the main flow direction of the flow medium on the inner tube wall. A possible swirling movement of the water-steam mixture is stopped by the guide profile and the water-steam mixture is introduced in such a geometrical position into the flow turbulence damper that the latter can expediently fulfill its function.

To make an especially simple construction of the flow turbulence dampers possible the flow turbulence dampers can be inserted directly during the production of the tubes. To this end the flow turbulence dampers are advantageously manufactured from a substance which has a composition similar to or the same as the tube material. This additionally prevents too great a mechanical stress on the tubes which would arise with different materials for tube and flow turbulence damper and/or the guide profile through the different thermal expansion properties.

The benefits obtained with the invention especially lie in the fact that the steam-side arrangement of an additional distributor elements between the respective water separation element and the inlet collector of the downstream superheater surfaces achieves an even distribution of the flow medium to the superheater tubes, even with a significantly smaller number of water separation elements. The reduction in the number of water separation elements is only made possible by these measures. This means a significantly lower production cost and a comparatively lower complexity of the tube system of the waste heat steam generator and an especially high operational flexibility can be achieved even in start-up or low-load mode.

BRIEF DESCRIPTION OF THE DRAWINGS

An exemplary embodiment of the invention is explained below in greater detail with reference to a drawing. The figures show.

The same parts are provided with the same reference characters in all figures.

DETAILED DESCRIPTION OF INVENTION

Figure 1:
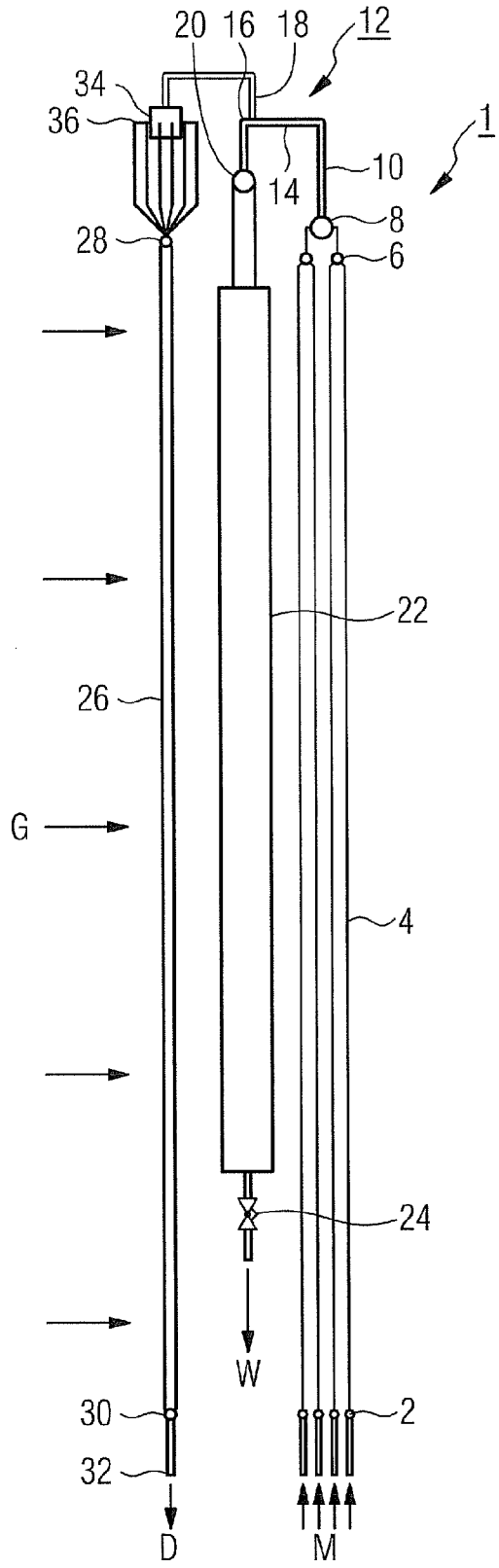
FIG. 1 the evaporator of a waste heat steam generator with horizontal flue gas path, seen from the side, FIG. 2 the evaporator of a waste heat steam generators from FIG. 1, seen from above, FIG. 3 the evaporator of a waste heat steam generator from FIGS. 1 and 2, seen in the direction of the flue gas path, FIG. 4 the evaporator of a waste heat steam generator with a vertical flue gas path, seen from the side, and FIG. 5 a T-piece water separation element.

FIG. 1 shows a schematic diagram of waste heat steam generator 1 with horizontal flue gas path. The flow medium M is injected into the tube system from an upstream feed pump not shown in the figure. Initially it flows in this case into a number of evaporator inlet collectors 2 which handle the distribution of the flow medium M to four evaporator heating surfaces with evaporator tubes 4 in which the flow medium is then evaporated. If necessary further evaporator heating surfaces can also be connected upstream or the heating surfaces can be arranged in the hot gas duct in different geometrical embodiments.

A number of evaporator tubes 4 in each case open out into a common transitional tube section 10 over a first evaporator exit collector 6 and a second exit collector 8, downstream of which is connected the T-piece water separator element 12. The T-piece water separator element comprises an inflow tube section 14 which, when seen in its longitudinal direction, extends into a water evacuation tube section 16, with an outflow tube section 18 branching off in the transitional area. The water evacuation tube section 16 opens out into a blowdown pipe 20, downstream of which is connected a collection container 22 arranged outside the flue gas duct. Connected to the collection container 22 is an outlet valve 24 via which the separated water is either discarded or can be fed back into the evaporation circuit.

Flow medium M enters the T-piece water separation element 12 through the inflow tube section 14. The proportion of water W flows dependent on its mass inertia into the water evacuation tube section 16 following on in the longitudinal direction. The steam D on the other hand, as a result of its lower mass, follows the redirection forced by the pressure circumstances into the outflow tube section 18. The outflow tube section 18 has the superheater tubes 26 in two superheater surfaces connected downstream from it via a superheater inlet collector 28. The superheater tubes 26 finally open out into a superheater outlet collector 30.

The steam D is collected there and fed through the steam outlet 32 for further use: usually an apparatus not shown in greater detail in FIG. 1, such as a steam turbine for example, is provided.

If necessary the outlet valve 24 can be closed and thus an oversupply of the T-piece water separation elements 12 brought about. In such cases unevaporated water W still flows into the superheater tubes 26 so that this can still be used for further evaporation, i.e. the evaporation end point can be displaced into the superheater tubes, which makes possible comparatively high flexibility in the operation of the waste heat steam generator 1.

In order to make possible an especially simple construction of the waste heat steam generator 1, a comparatively small number of T-piece water separation elements 12 should be used. To compensate for the inhomogeneities caused in respect of the distribution to the superheater tubes and thus to make this type of embodiment possible at all, the T-piece water separation elements 34 are connected between the two as types of star distributor. These handle a pre-distribution of the flow medium M in the case of an oversupply of the T-piece water separation elements 12 to the superheater inlet collectors 28.

Figure 2:
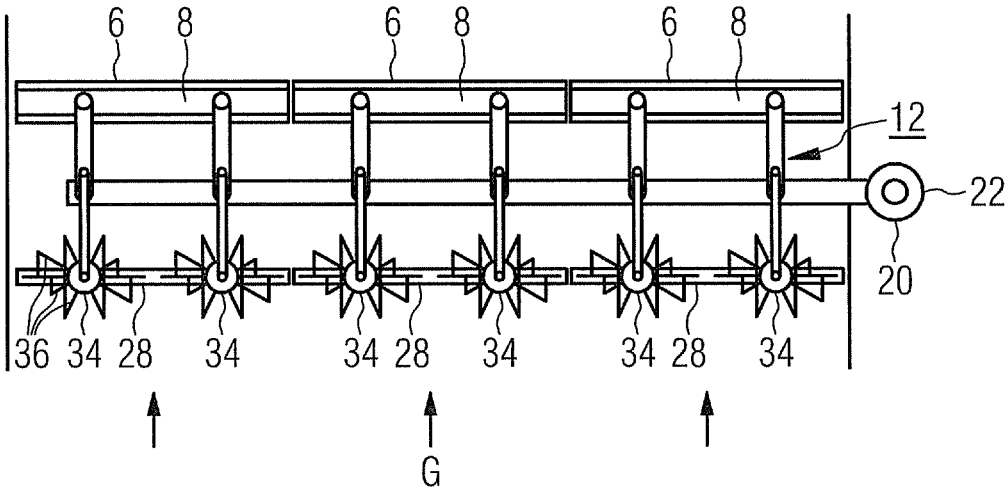

The functioning of the distributor elements 34 in the form of star distributors can be seen from an overhead view of the waste heat steam generator 1 in accordance with FIG. 2. Also visible in the diagram are the first and second evaporator outlet collectors 6, 8, and also the T-piece water separation elements 12, the blowdown pipe 20 and the collection container 22.

In the distributor elements 34 embodied as star distributors the flow medium M strikes a circular baffle plate and is redirected from there into star-shaped concentric-symmetrically arranged outlet tubes 36. The symmetrical arrangement of the eight outlet tubes 36 in the exemplary embodiment shown means that in this case each outlet tube 36 is allocated around the same amount of flow medium M. These tubes open out at equal intervals into the superheater inlet collector 28 so that there is already a pre-distribution of the flow medium M over the entire width of the superheater inlet collector 28.

Figure 3:
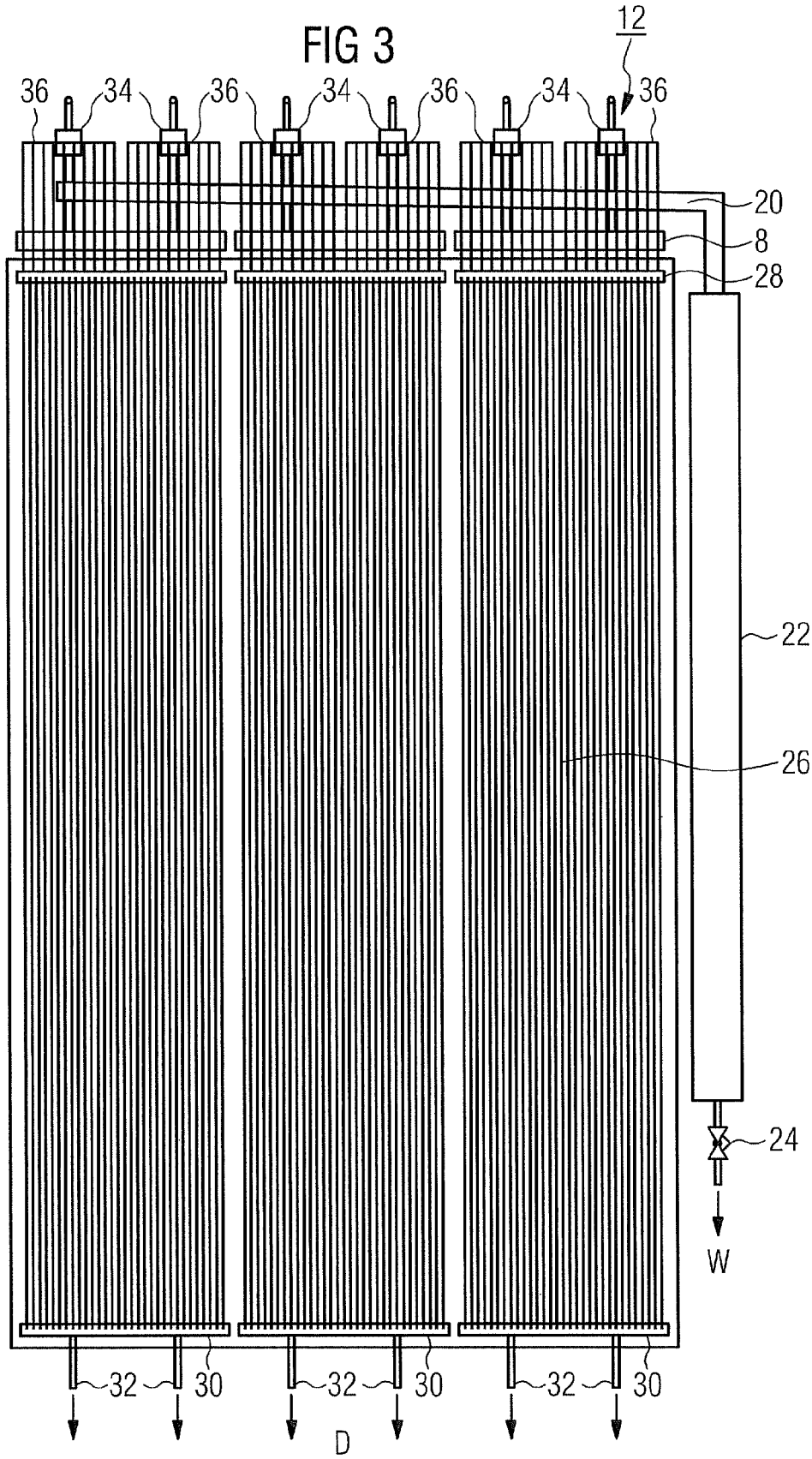

The further introduction from the superheater inlet collector 28 into the superheater tubes 26 is clearly shown by FIG. 3, which shows the waste heat steam generator 1 from the direction of the flue gas inlet. Visible in the diagram are the second evaporator outlet collector 8 and also the T-piece water separation elements 12, the blowdown pipe 20, the collection container 22 with the outlet valve 24 and also the distributor elements 34 with the outflow tubes 36 which open out into the superheater inlet collector 28.

FIG. 3 clearly shows the benefits of pre-distribution: The flow medium M is already distributed by the distribution elements 34 via the eight respective outlet tubes homogenously over the entire width of the superheater inlet collector 28. For a direct introduction of the flow medium M via a single line per T-piece water separation element 12 the flow medium M would not be evenly distributed into the superheater inlet collectors 28, since, as a result of the width of the superheater surface, these are not suitable for this type of homogeneous distribution from a single supply line for example.

Figure 4:
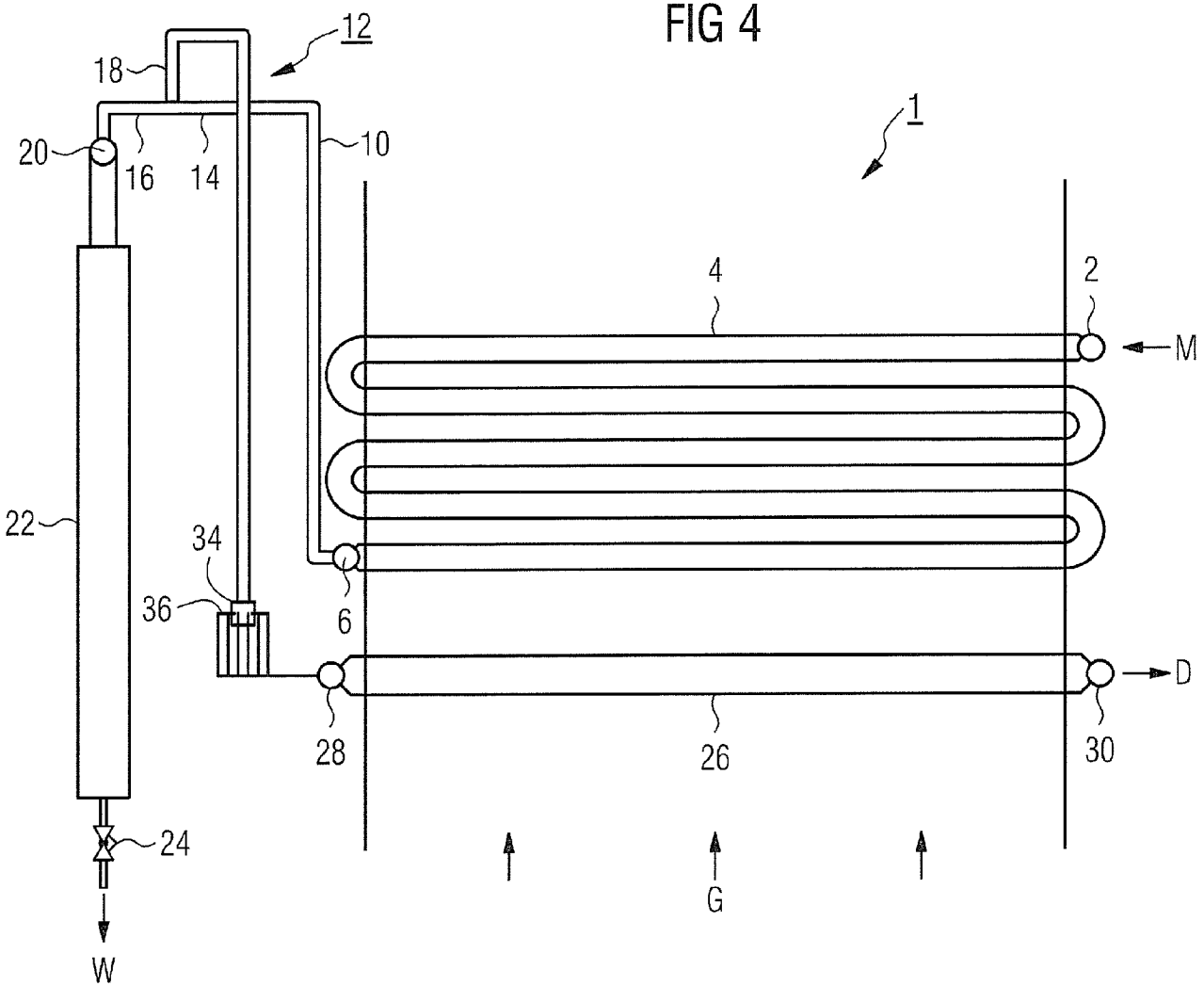

FIG. 4 shows an alternate form of embodiment, namely a waste heat steam generator 1 with a vertical flue gas direction, seen from the side. The components and their function are essentially identical to the steam generator shown in FIG. 1 through 3, only the evaporator tubes 4 and the superheater tubes 26 are arranged horizontally. The evaporator tubes 4 are guided in windings multiply through the hot gas duct.

Figure 5:
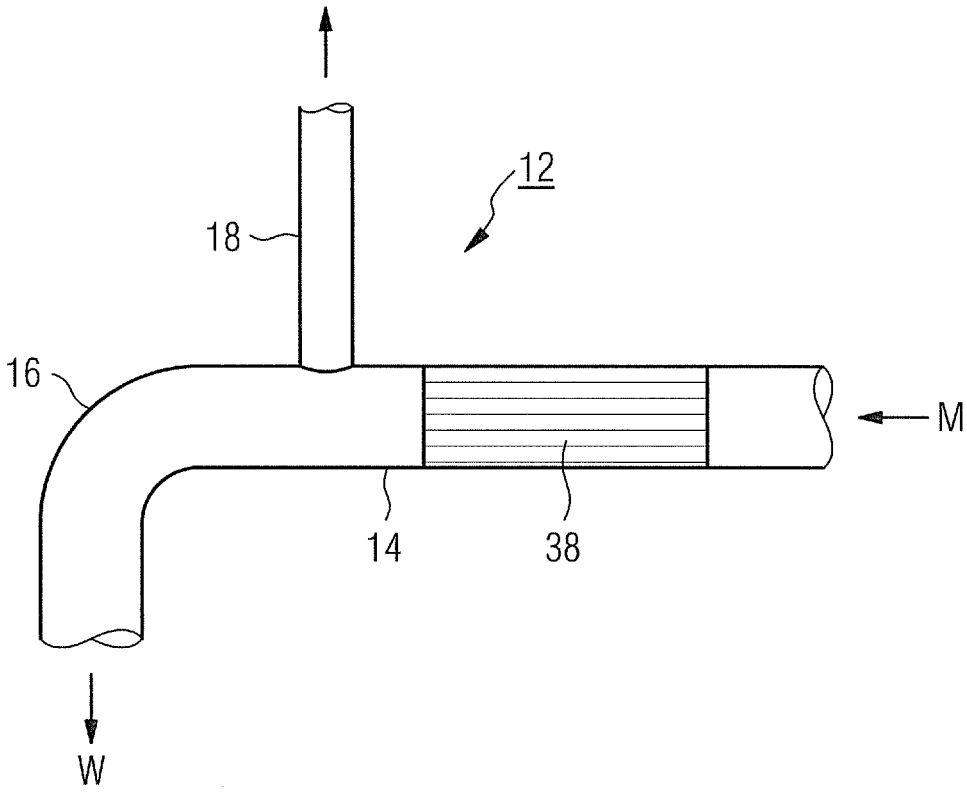

The smaller number of T-piece water separation elements 12 means that each of these individual elements is dimensioned comparatively larger. To avoid a comparatively high mechanical stress on these T-piece water separation elements and on the superheater tubes 4 connected downstream from them with such a large application of flow medium M, flow turbulence dampers 38 are provided in an area connected upstream from the T-piece water separation elements 12. These can typically be accommodated in an outlet area of the evaporator tubes 4, in the exemplary embodiment shown they are inserted into the inflow tube section 14 of the T piece water separation element 12 which is shown separately in FIG. 5.

The flow turbulence dampers 38 can for example comprise a number of bulkheads or guide profiles, which can be made of the same material as the inflow tube section 14. They can also be adapted in respect of their geometrical parameters to the local flow conditions provided during operation.

Slugs and other turbulent flows are reduced by the flow turbulence dampers 38 and the mechanical stress on the downstream components is reduced. In particular in the areas of the outflow tubes section 18 and the water evacuation tube section 16 bent round at right angles, pulsation-free operation is thus possible even with a comparatively large dimensioning of the T-piece water separation elements 12.

The invention claimed is:

1. A waste heat steam generator, comprising:

a plurality of evaporator tubes connected in parallel on the flow medium side;

a plurality of superheater tubes; and a water separation system, comprising:

a plurality of water separation elements, each comprising:

an inflow tube section connected to the respective upstream evaporator tubes, wherein the plurality of superheater tubes are connected downstream of the plurality of evaporator tubes via the water separation system, wherein each of the plurality of water separation elements of the water separation system is connected to one or more tubes of the plurality of the upstream evaporator tubes and connected to one or more tubes of the plurality of downstream superheater tubes wherein when seen in a longitudinal direction, the inflow tube section extends into a water evacuation tube section, wherein a plurality of outflow tube sections branch off in a transitional area and are connected to an inlet collector of the respective downstream superheater tubes, wherein a distributor element is arranged on a steam side between the respective water separation element and the inlet collector and wherein the respective distributor element comprises a baffle plate, an inlet tube arranged at right angles to the baffle plate and a plurality of outlet tubes arranged in a star shape around the baffle plate.

2. The waste heat steam generator as claimed in claim 1, wherein the geometrical parameters of a plurality of outlet tubes of the respective distributor element are selected such that a homogenous flow distribution to the inlet collector of the respective downstream superheater tubes is guaranteed.

3. The waste heat steam generator as claimed in claim 1, wherein the baffle plate is circular in shape and the plurality of outlet tubes are arranged concentric to a center of the baffle plate equally spaced from the respective adjacent outlet tubes.

4. The waste heat steam generator as claimed in claim 1, wherein the respective distributor element includes between 5 and 20 outlet tubes.

5. A waste heat steam generator, comprising:

a plurality of evaporator tubes connected in parallel on the flow medium side;

a plurality of superheater tubes; and a water separation system, comprising:

a plurality of water separation elements, each comprising:

an inflow tube section connected to the respective upstream evaporator tubes, wherein the plurality of superheater tubes are connected downstream of the plurality of evaporator tubes via a water separation system, wherein each of the plurality of water separation elements of the water separation system is connected to one or more tubes of the plurality of the upstream evaporator tubes and connected to one or more tubes of the plurality of downstream superheater tubes, wherein when seen in a longitudinal direction, the inflow tube section extends into a water evacuation tube section, wherein a plurality of outflow tube sections branch off in a transitional area and are connected to an inlet collector of the respective downstream superheater tubes, wherein a distributor element is arranged on a steam side between the respective water separation element and the inlet collector and wherein the respective distributor element comprises a baffle plate, an inlet tube arranged at right angles to the baffle plate and a plurality of outlet tubes arranged in a star shape around the baffle plate, wherein a flow turbulence damper is provided in each of the inflow tube sections of the plurality of water separation elements.

6. The waste heat steam generator as claimed in claim 5, wherein the flow turbulence damper includes a plurality of bulkheads, and wherein each bulkhead closes off a part of the tube cross-section.

7. The waste heat steam generator as claimed in claim 5, wherein the flow turbulence damper on the inner wall of the tube has a number of guide profiles aligned in a main flow direction of a flow medium.

8. The waste heat steam generator as claimed in claim 5, wherein the flow turbulence damper includes a substance with a composition the same as or similar to a tube material of the inflow tube.

* * * * *